US008505930B2

(12) United States Patent
Niewöhner

(10) Patent No.: US 8,505,930 B2
(45) Date of Patent: Aug. 13, 2013

(54) SKATE SHOE WITH BAYONET-LIKE CLOSURE MADE UP OF TWO HALF-AXES

(76) Inventor: Sabine Niewöhner, Gütersloh (DE)

( * ) Notice: Subject to any disclaimer, the term of this patent is extended or adjusted under 35 U.S.C. 154(b) by 416 days.

(21) Appl. No.: 12/936,174

(22) PCT Filed: Mar. 26, 2009

(86) PCT No.: PCT/DE2009/000416

§ 371 (c)(1),
(2), (4) Date: Dec. 8, 2010

(87) PCT Pub. No.: WO2009/121338

PCT Pub. Date: Oct. 8, 2009

(65) Prior Publication Data

US 2011/0146107 A1 Jun. 23, 2011

(30) Foreign Application Priority Data

Apr. 4, 2008 (DE) ..... 10 2008 017 195

(51) Int. Cl.
*A63C 17/06* (2006.01)

(52) U.S. Cl.
USPC ..... 280/11.223

(58) Field of Classification Search
CPC ..... A43B 5/1633; A43B 5/1641
USPC ..... 280/7.13, 11.19, 11.204, 11.223, 280/11.24, 11.27, 11.28, 11.3, 11.31, 841, 280/843; 36/82, 100, 115, 36 R, 36 B
See application file for complete search history.

(56) References Cited

U.S. PATENT DOCUMENTS

| | | | | |
|---|---|---|---|---|
| 3,046,032 | A * | 7/1962 | Humphries | 280/11.19 |
| 3,476,399 | A * | 11/1969 | Finn | 280/11.25 |
| 5,511,824 | A * | 4/1996 | Kim | 280/841 |
| 6,354,609 | B1 * | 3/2002 | Chen et al. | 280/11.3 |
| 6,406,039 | B1 * | 6/2002 | Chen | 280/11.27 |
| 6,454,279 | B1 * | 9/2002 | Yang | 280/11.223 |
| 6,488,289 | B2 * | 12/2002 | Hsiao et al. | 280/11.208 |
| 6,719,304 | B2 * | 4/2004 | Miller et al. | 280/11.27 |
| 6,805,363 | B2 * | 10/2004 | Hernandez | 280/11.19 |
| 6,959,933 | B1 * | 11/2005 | Roth | 280/11.25 |
| 7,063,336 | B2 * | 6/2006 | Adams | 280/11.221 |
| 7,165,774 | B2 * | 1/2007 | Adams | 280/11.221 |
| 7,850,175 | B2 * | 12/2010 | Wegener | 280/11.19 |
| 2001/0009632 | A1 * | 7/2001 | Cross | 403/322.2 |
| 2002/0125655 | A1 * | 9/2002 | Hsiao et al. | 280/11.19 |
| 2002/0145263 | A1 * | 10/2002 | Yang | 280/11.19 |

(Continued)

FOREIGN PATENT DOCUMENTS

WO WO 2005/0120664 A 12/2005

*Primary Examiner* — Katy M Ebner
*Assistant Examiner* — Brodie Follman
(74) *Attorney, Agent, or Firm* — Edwin D. Schindler

(57) ABSTRACT

A skate shoe includes a shoe having a sole through which runs a horizontal bore. From both sides of the horizontal bore of the sole, a half-axle is inserted with a wheel fixed at an outer end of each half-axle. The two half-axles have at least one flattened portion on their respective inner ends, which is located within the horizontal bore. The two flattened portions overlap within the bore and, in a second half of each flattened portion that is closer to the respective wheel, there is a recess. The each recess is complementary formed to a detent lug in a first half of the respective flattened portion and with the detent being able to pivot into the recess of the other half-axle.

9 Claims, 2 Drawing Sheets

(56) References Cited

U.S. PATENT DOCUMENTS

Figure 1:
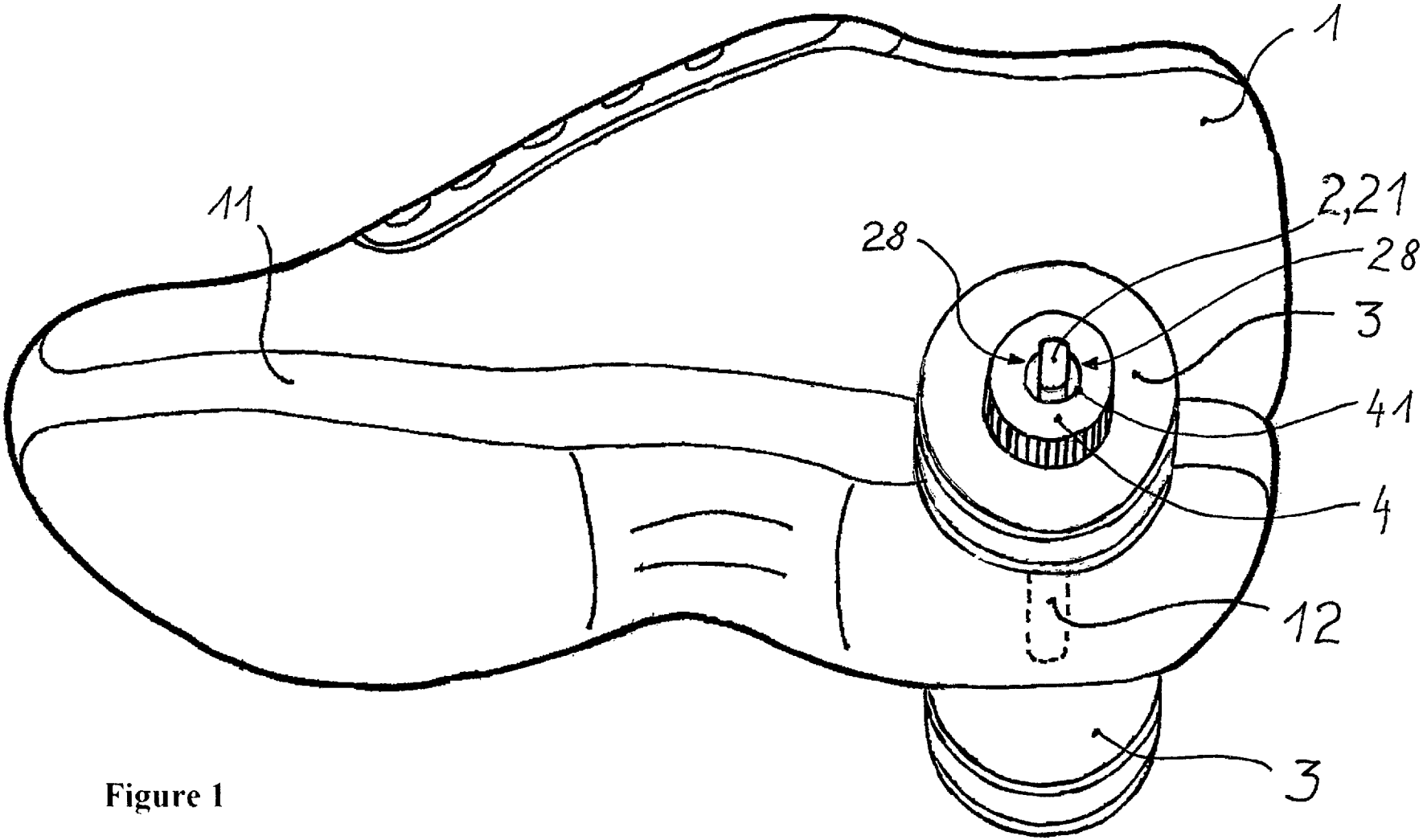

2004/0036237 A1* 2/2004 Hernandez ..... 280/11.3
2008/0185798 A1* 8/2008 Abel et al. ..... 280/11.19
2008/0235990 A1* 10/2008 Wegener ..... 36/100
2008/0256831 A1* 10/2008 Maiores ..... 36/115
2009/0079147 A1* 3/2009 Conners et al. ..... 280/11.223
2010/0090422 A1* 4/2010 Chan et al. ..... 280/11.27
2010/0289230 A1* 11/2010 Duarte et al. ..... 280/11.204
2012/0013087 A1* 1/2012 Adams ..... 280/11.27

* cited by examiner

SKATE SHOE WITH BAYONET-LIKE CLOSURE MADE UP OF TWO HALF-AXES

BACKGROUND OF THE INVENTION

1. Technical Field of the Invention

The invention relates to a skate shoe, consisting of a shoe, through the sole of which a bore runs horizontally, into which, from both sides, a half-axle in each case is inserted, at the outer end of which a wheel in each case is fixed.

2. Description of the Prior Art

A skate shoe differs from the roller skates and inliners that have been known for decades, and in which at least two rollers are arranged one behind the other over the entire length of the shoe, in that no rollers are present in the frontal region of the shoe, but only in the rear region.

It is known that only a single roller is inserted in the underside of the heel; however, also widespread are two rollers, which are fixed on both sides of the heel. By this means, the user of the skate shoe can either run on the front portion of the shoes, e.g. during acceleration, the rear portion of the shoe with the rollers having no contact with the running surface, or the user can lift the tips of the toes and roll on the rollers in the rear portion of the shoes, in a similar way to a roller skate.

The user can thus rapidly change between walking, running or rolling. As a consequence, between the running surface of the shoe and the rolling surface of the wheels, with the feet in a normal posture, the height difference must not be too great, so that the angle of the required pivot of the shoe remains small during changeover from running to rolling, and vice versa.

To choose the diameters of the rollers as great as possible, so that the stability is as large as possible and smaller obstructions can be rolled over, the axle must be as high possible. Since the axle cannot cross through the interior space of the shoe, the remaining alternative for fastening is that the axle must pass through the shoe sole.

This opens the possibility of designing the shoe as a normal sports or street shoe, as a result of which, as a further consequence, it follows that the users often want to completely remove the rollers, so that the shoe can be used as a normal running shoe or sport shoe.

For the removal of the wheels and dismounting of the axle, numerous proposals exist in the prior art, which, however, have several disadvantages associated with them.

For example, WO 2005/120664 discloses designs that permit folding away of the axles into the underside of the shoe. For this purpose, recesses are necessary, which very rapidly become dirty, and thereby make the change from running shoe to roller shoe considerably more difficult or even impossible.

An alternative are screw connections, which must be released to dismount the axle and wheels, which requires an additional tool. The disadvantage is that this tool must be procured and kept ready. The most unpleasant things for the use are the repeated application of the tool and the long times for mounting and dismounting.

Also known are proposals in which splints, bars or pins are inserted in the axles or in axial elements. A handicap is that the connecting parts can be covered against dirt on the running surface and thereby the mounting and dismounting at least hindered or even made impossible. This disadvantage is that these connecting elements can loosen, which raises the risk of falling and the loss of the elements.

SUMMARY OF THE INVENTION

Against this background, it is the object of the invention to develop a skate shoe with detachable axles.

in which, for fastening the axles, a simplest possible device in the shoe is created, and in which the mounting and dismounting of the axles is possible without a special tool, and in which the connecting points between the axles are protected as effectively as possible, and in which only a very short period is required for mounting and dismounting.

As a solution, the invention provides that the two half-axles have at least one flattened portion on their inner end, which is located within the bore, and the two flattened portions overlap within the bore, and, in the second half of each flattened portion that is closer to the wheel, a recess is introduced, which is formed complementary to a detent lug in the first half of the flattened portion, and the detent lug is pivoted into the recess of the respective other half-axle.

The fastening of the two half-axles according to the invention requires only one continuous bore in the shoe sole, which, e.g., is easily achieved by means of a block, which is cast into the shoe sole. Of all the conceivable recesses, a bore is by far the easiest to produce. The compatible form of the axle, namely a round steel, is also so easy to produce that corresponding material, in the prior art, is available in different material qualities and at relatively favourable prices.

The gist of and the most important advantage of the invention is that the connection of the two half-axles to one another is only produced by pivoting the two detent lugs into the recess on the respective other half-axle. This greatly shortens the mounting and dismounting time.

The connecting point of the two half-axles within each shoe is disposed in the centre of the block of the bore and is thereby subject to the least conceivable degree to peak loads due to jumps with the skate shoes or during running over steps, since this load is received by the bore in the shoe sole. Only when cornering is it conceivable, according to the users foot posture, to exert forces in the direction of the longitudinal axis of the half-axles, specifically when the wheel on the inside of the corner is very much more severely loaded than the outer wheel. For this loading case, however, the load-bearing capacity of the joint can be checked with a simple calculation and, if necessary, the dimensioning be strengthened and/or harder material chosen.

DETAILED DESCRIPTION OF THE PREFERRED EMBODIMENTS

In a preferred embodiment, the two flattened portion in the region of the connection are produced in that a short portion of the longitudinal axis is milled away to half its thickness, and a semicircular profile remains. The semicircular profiles or flattened portions at the inner end of each half-axle overlap in the centre of the bore and thereby complement one another to form a full circle.

To interlock the two half-axles with one another, the two flattened portions are provided in each case with a recess. In a preferred embodiment, the recess receives the second half of each flattened portion, which is closest to the outer end of the half-axle. When the recess is inserted to exactly half of the flattened portion, the remaining, first half inevitably has the same length and is thereby complementary to the recess.

Likewise, it is a preferred embodiment that the flattened portion is also subdivided in its cross-section into two halves of the semicircular profile of the flattened portion, the half, that is to say a quarter of the circular segment, is milled out of the flattened portion as a recess. The detent lug on the other half-axle can be pivoted into this milled recess by a quarter turn. By this means, the connection of the two half-axles can be secured against tensile forces that would cause the half-axles to slip out of the bore again.

The connection according to the invention of the two half-axles, to this extent, resembles a bayonet connection, since the two elements to be connected, in the first step, are plugged into one another in the longitudinal direction, and then, in a second step, are interlocked with one another by a rotation. For a complete bayonet connection, the connection according to the invention lacks the third step, namely a movement parallel to the first step, however in the opposite direction to the original insertion. The movement line of a bayonet during plugging together thus corresponds to the letter J; in the case according to the invention, however, only an L is described as movement line.

It is conceivable also to extend the connection according to the invention into a bayonet, for which purpose, in the side wall of the recess, which faces the inner end of the half-axle, a groove or another recess must be introduced, into which a corresponding shape on the lateral surface of the detent lug of the second half-axle engages. To make this connection stable, a compression spring must be used, which presses together the two parts to be connected, in their engaged position, by spring pressure. The force of these springs must be overcome on mounting of the two halves, that is to say during final engagement of the bayonet.

The suitability of a bayonet connection of this kind for the two half-axles of a skate shoe, however, restricts cornering, since in this case tensile and compressive forces occur in the longitudinal direction, which can compress the compression spring of the bayonet so that the two halves can be accidentally detached from one another.

Therefore the invention prefers that the engagement is not, as with a bayonet, secured in the longitudinal direction against the pressure of a spring, which also acts as a stop, but instead the stop is fixed and a—smaller—spring only serves as rotation prevention for the pivoting movement of the two axles with respect to one another.

In a corresponding embodiment, in a wall of the recess oriented transversely to the longitudinal axis of the half-axle, a blind hole is introduced. Out of this blind hole, a detent element projects, which can be pressed into the blind hole against the force of a small spring. In that surface of the detent lug on the other half-axle that is complementary to the aforementioned wall, an indentation is formed complementary to the detent element. As securing, the detent element, e.g. a ball, is pressed by the compression spring into the indentation on the lateral surface of the detent lug. By this means unintentional pivoting of the two half-axles with respect to one another is inhibited.

The detent element is pressed sideward by the front edge of the detent lug, and then slides on the detent lug until it engages in the complementary indentation. The engagement is audible as a click and gives the user acoustic feedback that the connection has been successfully produced.

The advantage of this securing with respect to a bayonet connection is that it excludes a longitudinal movement of the two half-axles with respect to one another. The skate shoe can thus be used for cornering without restriction.

In a further refined embodiment, each half-axle has, directly next to the sole at the edge of the bore, an axial flange whose diameter is greater than the diameter of the bore. The advantage of this axial flange is that the bearing of the two half-axles within the sole is completely decoupled from the bearing of the wheels. When cornering, forces acting in the longitudinal direction of the half-axles are received by the axial flanges and the end faces of the bore in the sole.

As a further improvement of the fittings of a skate shoe according to the invention, a new variant for rapid mounting and mounting of the wheels is proposed.

A known possibility that is very simple in construction is to screw a nut onto the outer end of the half-axle, which prevents the wheels of sliding of the half-axle. To secure such a screw connection against unintentional detachment it is known in the prior art to use, e.g. a counter nut or a washer, which engages with a highly curved edge into a corresponding indentation of the nut, or a clamping screw that presses radially on the internal thread, or a plastic ring that is forced into the respective outermost screw thread.

Through millions of similar screw connections it has been demonstrated that, in the case of a skate shoe, too, such a connection can be achieved with adequately secure stability. The restriction remains that a suitable tool for detachment and a relatively long mounting time are necessary.

The invention therefore prefers another design to secure against slipping off of the wheels. Close to the outer end of each half-axle, at least one flat key surface is formed in each half-axle parallel to the longitudinal axis.

Subsequently a ring groove that runs around the half-axle is introduced on all key surfaces. Into this ring groove there engages a locking element, which is fastened to a retaining washer. This retaining washer bears directly against the wheel and fixes it on the half-axle. To allow the retaining washer to be pushed over the outer end of the half-axle, the silhouette of the locking element is formed so as to be complementary to the key surface. When the retaining washer is brought into that angular position, in which all locking elements are oriented opposite all key surfaces on the outer end of the half-axle, the retaining washer can be pulled off and then also removed from the wheel.

If, in the ring groove, at least one stop is arranged, which interrupts the ring groove, it limits the pivot angle of the retaining disk with respect to the half-axle. By this means, the retaining disk, in addition to securing the wheels, can also be used as a tool for pivoting the two half-axles into one another, that is to say for mounting and dismounting the half-axles in the sole.

To further increase the traction of the retaining washers, ribs, corrugations, cross-corrugations or handle recesses can be arranged on their outer end face, which permit improved transmission of a torque applied by hand.

In a simple embodiment of the retaining washer, it has, in the centre, a bore whose diameter corresponds to the outer end of the half-axle. When the retaining washer with its locking element engages in the ring groove, the end of the half-axle can project somewhat beyond the retaining washer.

However, it is also conceivable that this bore in the retaining washer can be closed by an additional cap. Then, during travel, no dirt can penetrate between the key surface and the bore in the retaining washer.

As additional rotation prevention for the retaining washer, a pin, which is movable in the longitudinal direction, can be provided in the outer end face of the half-axle. This pin is pressed outwardly by a spring, and when the retaining disk is put on, is pushed against the force of the spring back into the half-axle. As soon as the locking element on the retaining washer engages in the annular groove, and then the retaining washer is relieved, the pin, via the body of the retaining washer, also pushes the locking element against the wall of the annular groove and thereby limits accidental rotation of the retaining washer.

The principle of the two half-axles for supporting the wheels of a skate shoe also permits different dimensions of the half-axles provided that each detent lug is designed so as to be complementary to the recess on the other half-axle. Here, the dimensions of the two detent lugs can differ from one another.

The diameters of the two half-axles can be different as long as they are only complementary to the respective diameter. In this case the diameter of the bores is different between the left and right sides.

Since, from these different dimensions, however, no functional or production advantage can be obtained, the invention prefers that both half-axles are identical, which not only perceptibly aids manufacture but also their use.

In a skate shoe according to the invention, the following process results for mounting of the two half-axles in the bore through the shoe sole.

In the first step, one half-axle in each case is introduced from one side in each case into the bore to the extent that the inner ends come into contact with one another In the second step, one half-axle is secured against rotation in its longitudinal axis, and the other half-axle is pivoted about its longitudinal axis to the extent that the two flattened portions are opposite one another with respect to their longitudinal axis.

In the third step, the two half-axles are inserted along their longitudinal axles fully into the bore until the inner ends of each half-axle but against the end of the flattened portion of the other half-axle and each detent lug is opposite a recess.

In the fourth step, one of the two half-axles is again secured against rotation about its longitudinal axle and the other half-axle is then pivoted about its longitudinal axis to the extent that each detent lug engages in the recess on the other half-axle.

In the preferred embodiment, in which the recess has the form of a quarter cylinder, this half-axle is then pivoted through a quarter turn, that is to say through 90°, until the detent lugs are then completely pivoted into the recess. If a spring-loaded detent element and a complementary recess on the opposite side are provided on the lateral surfaces of the detent lug and recess, a click is audible at the end of the pivoting movement as acoustic feedback of the successful completion of the pivoting movement.

With these movements both in the longitudinal direction and during pivoting, the two retaining disks serve as grip surfaces for the actuating hand of the user.

To dismount a wheel from a half-axle, three steps are necessary:

In the first step, the retaining disk is pivoted with respect to the half-axle to the extent that the edges of all locking elements are flush with a key surface in each case In the second step, the retaining washer is pulled off the half-axle and In the third step, the wheel, too, is pulled off the half-axle.

By this means the half-axle and wheels can be stored separately from one another and therefore in a space saving manner. It is also advantageous that the elements can be thereby easily cleaned and if necessary the bearing of the wheel can be greased. It is similarly quick to exchange a wheel.

BRIEF DESCRIPTION OF THE DRAWING FIGURES

Further details and features of the invention are explained below in greater detail with reference to an example. This is not intended to restrict the invention, but only to explain it. In schematic view, FIG. 1 shows an oblique view of a skate shoe seen from its sole.

Figure 2:
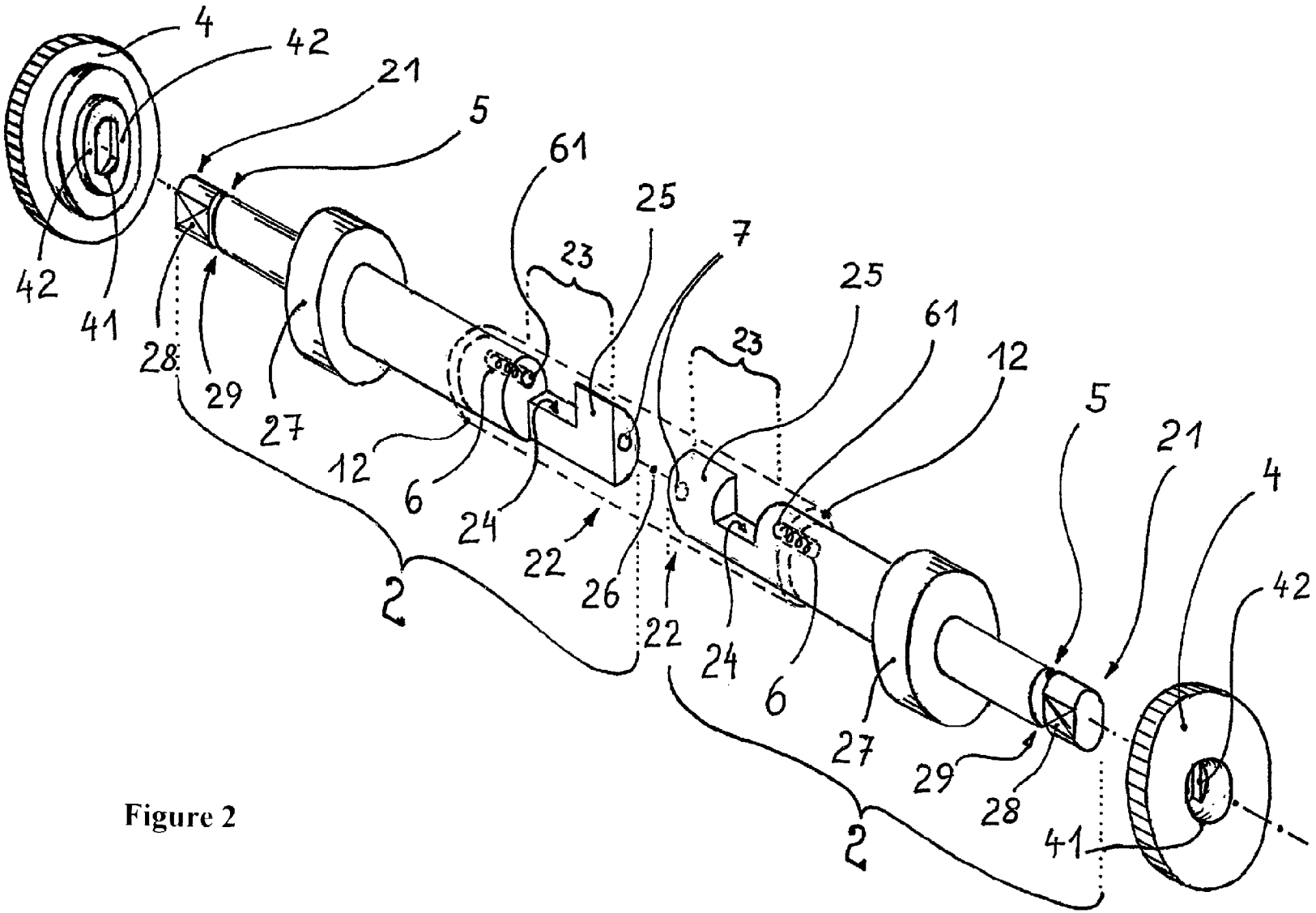

FIG. 2 shows an oblique view of two half-axles and two retaining washers shortly before assembly.

DETAILED DESCRIPTION OF THE DRAWING FIGURE

In detail, the figures show:

FIG. 1 shows, in perspective view, a shoe 1 extended to a skate shoe. It shows its sole 11 and one side. The two half-axles 2 are inserted in the bore 12 in the sole 11 and one wheel 3 in each case is mounted on each half-axle 2. Of the two half-axles, only the outer end 21 of a half-axle 2 can be seen.

Against the completely visible wheel 3, the retaining washer 4 bears, the bore 41 of which projects through the outer end 21 of a half-axle 2. It can be very readily seen that this outer end 21 is flattened at two sides so that two key surfaces 28 are formed.

In FIG. 1, it cannot be seen that one locking element 42, whose edge is flush with the key surface 28, projects into the bore 41 of the retaining washer 4.

FIG. 1 thus shows a skate shoe with mounted half-axles 2 and mounted wheels 3.

In FIG. 2, two half-axles 2 and two retaining washers 4 are shown in perspective. The two half-axles 2 are already partly inserted in the bore 12 (shown with a broken line). The two flattened portions 23 of the two half-axles 2 are already brought close together and oriented such that, when the half-axles 2 are further pushed against one another, they can slide past one another and then overlap.

Each of the two flattened portions 23 is subdivided into two halves. The detent lug 25 projects close to the inner end 22 of the half-axle 2, on the first half. The adjacent recess 24 is milled into the second half of the flattened portion 23. The two halves of the flattened portion have the same length, so that the detent lugs 25 are complementary to the recesses.

In FIG. 2, it is very readily apparent that, as the two half-axles 2 are pushed in further, the flattened portions 23 overlap to an increasing extent. If the two detent lugs 25 have slid over one another and butted against the end of the respective opposite flattened portion 23, then the two detent lugs 25 are in each case on the same level as a recess 24. Since both the detent lugs 25, as well as the recesses 24, have in each case the form of a quarter cylinder and are of the same length, they are complementary to one another.

Therefore, by pivoting a half-axle 2, each detent lug 25 can be pivoted into the recess 24 on the respective other half-axle 2, and completely fill it. Then the two detent lugs 25 are interlocked with one another in the manner of a claw, and in this way secure the two half-axles against slipping out of the bore 12.

In FIG. 2, it can be seen that the detent lugs 25 in the pivoted position are secured by a detent element 61, which is movable in a blind hole 6 against the force of a spring, and engages in a complementary indentation 7 in the end face on the inner end 22 of the half-axle 2.

FIG. 2 shows the two axial flanges 27 close to the outer end 21 of the half-axle 2. When the half-axles 2 are in a mounted state they are in contact with the end faces of the bore 12 at their inner side. The wheel 3—not shown in FIG. 2—lies against their outer surfaces. In FIG. 2, it can be seen how the retaining washer 4 is secured on the half-axle 2. The retaining washer 4 has a bore 41, whose diameter corresponds to the diameter of the outer end of the half-axle 2. Two locking elements 42 project into this bore 41. The inner edge of these locking elements 42 is flush with the surface of the two key surfaces 28 at the outer end 21 of the half-axles 2.

In FIG. 2, it is clear that the retaining washer 4 can only be pushed over the key surfaces 28 in the "correct" angular position, that is to say, in this case with vertical edges of the locking elements 42. At the end of this path, the locking elements 42 dip into the ring groove 29 and bear against the inside wall of the groove 29. When the retaining washer 4 is pivoted, the inwardly facing edges of the locking elements 42 slide into the annular groove 29. There they immediately come into contact with a stop 6, which interrupts the ring groove 29. This stop 5 can be seen in FIG. 2 only as a black dot at the end of the ring groove 29.

When the locking elements 42 bear against the stop 5, the retaining washer 4 can also be used as a grip surface for pivoting the half-axle 2.

FIG. 2 makes clear that the retaining washer 4 serves both for securing the wheels 3 and for mounting and dismounting the two half-axles 2 respectively in or out of the bore 12. The illustrated embodiment thus corresponds to the requirements of the object for rapid, simple and tool-free mounting and dismounting of the two half-axle and the wheels 3—not shown in FIG. 2.

LIST OF REFERENCE CHARACTERS

1 Shoe
11 Shoe sole 1
12 Bore in the sole 11
2 Half-axle, inserted into bore 12
21 Outer end of the half-axle 2
22 Inner end of the half-axle, located within the bore 12
23 Flattened portion at the end 22 of the half-axle 2
24 Recess in the second half of the flattened portion 23
25 Detent lug on the second half of the flattened portion 23
26 Longitudinal axis of the half-axles 2
27 Axle flange, on half-axle 2
28 Key surface at the outer end 21 of the half-axle 2
29 Ring groove, contiguous with key surface 28
3 Wheel on the outer end 21 of the half-axle 2
4 Retaining washer on the outer end 21 of the half-axle 2
41 Bore in the retaining washer 4
42 Locking element projects into the bore 41 and engages in ring groove 29
5 Stop, interrupts ring groove 29
6 Blind hole in the wall of the recess 24
61 Detent element in blind hole 6
7 Indentation in detent lug 25, complementary to the detent element 61

The invention claimed is:

1. A skate shoe, comprising:

a shoe having a sole with a horizontal bore passing through said sole;

a first half-axle inserted into a first side of the horizontal bore with said first half-axle having an inner end and an outer end and with a first wheel attached to said outer end of said first half-axle, said inner end of said first half-axle being located within the horizontal bore and having a first flattened portion with a first half and a second half thereof with said second half of said first flattened portion being closer to said first wheel;

a second half-axle inserted into a second side of the horizontal bore with said second half-axle having an inner end and an outer end and with a second wheel attached to said outer end of said second half-axle, said second side of the horizontal bore being a side at an opposite end of the horizontal bore relative to said first side of the horizontal bore, said inner end of said second half-axle being located within the horizontal bore and having a second flattened portion with a first half and a second half thereof with said second half of said second flattened portion being closer to said second wheel, said first flattened portion and said second flattened portion overlapping within the horizontal bore;

a first recess is located in said second half of said first flattened portion of said first half-axle;

a second recess is located in said second half of said second flattened portion of said second half-axle;

a first detent lug located on said first half of said first flattened portion of said first half-axle, said first detent lug being complementary with said second recess of said second half-axle;

a second detent lug located on said first half of said second flattened portion of said second half-axle, said second detent lug being complementary with first recess of said first half-axle;

a first pivot for pivoting said second detent lug of said second half-axle into said first recess of said first half-axle; and, a second pivot for pivoting said first detent lug of said first half-axle into said second recess of said second half-axle.

2. The skate shoe according to claim 1, wherein said first recess and said second recess have a first wall and second wall, respectively, oriented transversely to a longitudinal axis of a respective said half-axle, is a blind hole from which a detent element projects that is pressable into the blind hole against a biasing force and, into a surface of said detent lug that is complementary to a respective said wall, is an indentation that is complementary to a respective said detent element.

3. The skate shoe according to claim 1, wherein said first half-axle includes a first axial flange and said second half-axle includes a second axial flange, said first said axial flange and said second axial flange are each located adjacent the horizontal bore with a diameter of each of said first axial flange and said second axial flange being greater than a diameter of the horizontal bore.

4. The skate shoe according to claim 1, further comprising at least one flat key surface in close proximity to said outer end of each of said first half-axle and said second half-axle with said at least one flat key surface being formed in each of said first half-axle and said second half-axle.

5. The skate shoe according to claim 4, further comprising a ring grove contiguous with a respective said at least one flat key surface for each of said first half-axle and said second half-axle, said ring grove for each said half-axle surrounds each of said first half-axle and said second half-axle.

6. The skate shoe according to claim 4, further comprising a ring grove contiguous with a respective said at least one flat key surface for each of said first half-axle and said second half-axle, said ring grove for each said half-axle, and a first retaining washer contiguous with said first wheel and a second retaining washer contiguous with said second wheel, each respective said ring groove being interrupted at, at least, one point by a stop that blocks a securing element that contacts with said stop when a respective said retaining washer is pivoted relative to a respective said half-axle.

7. The skate shoe according to claim 1, further comprising a first retaining washer contiguous with said first wheel and a second retaining washer contiguous with said second wheel, said first retaining washer and said second retaining washer are, respectively, mounted onto said outer end of each of said first half-axle and said second half-axle.

8. The skate shoe according to claim 1, wherein said first half-axle and said second half-axle are of an identical construction.

9. A method for mounting two half-axles in a horizontal bore of a skate shoe, said skate shoe comprising:

a shoe having a sole with a horizontal bore passing through said sole;

a first half-axle inserted into a first side of the horizontal bore with said first half-axle having an inner end and an outer end and with a first wheel attached to said outer end of said first half-axle, said inner end of said first half-axle being located within the horizontal bore and having a first flattened portion with a first half and a second half thereof with said second half of said first flattened portion being closer to said first wheel;

a second half-axle inserted into a second side of the horizontal bore with said second half-axle having an inner end and an outer end and with a second wheel attached to said outer end of said second half-axle, said second side of the horizontal bore being a side at an opposite end of the horizontal bore relative to said first side of the horizontal bore, said inner end of said second half-axle being located within the horizontal bore and having a second flattened portion with a first half and a second half thereof with said second half of said second flattened portion being closer to said second wheel, said first flattened portion and said second flattened portion overlapping within the horizontal bore;

a first recess is located in said second half of said first flattened portion of said first half-axle;

a second recess is located in said second half of said second flattened portion of said second half-axle;

a first detent lug located on said first half of said first flattened portion of said first half-axle, said first detent lug being complementary with said second recess of said second half-axle;

a second detent lug located on said first half of said second flattened portion of said second half-axle, said second detent lug being complementary with first recess of said first half-axle;

a first pivot for pivoting said second detent lug of said second half-axle into said first recess of said first half-axle; and, a second pivot for pivoting said first detent lug of said first half-axle into said second recess of said second half-axle, said method comprising the steps of:

partially inserting said first half-axle into the first side of the horizontal bore;

partially inserting said second half-axle into the second side of the horizontal bore until said inner end of said second half-axle contacts said inner end of said first half-axle;

securing said first half-axle against rotation about its longitudinal axis;

pivoting said second half-axle about its longitudinal axis until said first flattened portion and said second flattened portion lie opposite one another relative to the longitudinal axis of each said first half-axle and said second half-axle;

completely inserting both said first half-axle and said second half-axle into the horizontal bore along their respective said longitudinal axis until said inner end of each of said first half-axle and said second half-axle abut an end of said flattened portion of said second half-axle and said first half-axle, respectively, and so that each of said first detent lug and said second detent lugs opposite said second recess and said first recess, respectively;

securing said first half-axle against rotation about its longitudinal axis; and, pivoting said second half-axle about its longitudinal axis to the extent that each of said first detent lug and said second detent lug engages, respectively, said second recess of said second half-axle and said first recess of said first half-axle.

* * * * *